US005322666A

United States Patent [19]

Watwe

[11] Patent Number: 5,322,666

[45] Date of Patent: Jun. 21, 1994

[54] MECHANICAL ALLOYING METHOD OF TITANIUM-BASE METALS BY USE OF A TIN PROCESS CONTROL AGENT

[75] Inventor: Arunkumar S. Watwe, Huntington, W. Va.

[73] Assignee: Inco Alloys International, Inc., Huntington, W. Va.

[21] Appl. No.: 856,625

[22] Filed: Mar. 24, 1992

[51] Int. Cl.[5] ..... B22F 1/00

[52] U.S. Cl. ..... 419/32; 75/249; 148/513; 419/33

[58] Field of Search ..... 75/0.5 R, 0.5 BC; 29/182.5; 148/11.5 F, 407, 437; 419/61, 32

[56] References Cited

U.S. PATENT DOCUMENTS 3,865,572 2/1975 Fisher et al. ..... 75/0.5 R
3,926,568 12/1975 Benjamin et al. ..... 29/182.5
4,578,129 3/1986 Rowe ..... 148/407
4,627,959 12/1986 Gilman et al. ..... 419/61
4,668,470 5/1987 Gilman et al. ..... 419/32
4,783,216 11/1988 Kemp et al. ..... 75/0.5 BB
4,834,942 5/1989 Frazier et al. ..... 420/552
5,000,910 3/1991 Tokizane et al. ..... 419/29

*Primary Examiner*—Donald P. Walsh
*Assistant Examiner*—J. N. Greaves
*Attorney, Agent, or Firm*—Blake T. Biederman; Edward A. Steen

[57] ABSTRACT

The invention provides a method of mechanical alloying a titanium-base metal powder. Titanium-base metal powder is provided in a mechanical alloying apparatus. The mechanical alloying apparatus has a controlled atmosphere to prevent excessive oxidation of the titanium-base metal powder. An effective amount of tin process control agent is added to the mechanical alloying apparatus. The mechanical alloying apparatus is operated to weld and fracture the titanium-base metal powder in a manner controlled by the tin process control agent. The controlled welding and fracturing ultimately forms a titanium-base mechanically alloyed powder.

15 Claims, 1 Drawing Sheet

MECHANICAL ALLOYING METHOD OF TITANIUM-BASE METALS BY USE OF A TIN PROCESS CONTROL AGENT

FIELD OF INVENTION

This invention is related to the field of controlled mechanical alloying of metal powder by the addition of a process control agent.

BACKGROUND OF THE ART AND PROBLEM

Mechanical alloying is a process of repeated fracturing and welding used to form alloys of unique composition, morphology and structure. Mechanical alloying is capable of producing dispersion strengthened alloys that are not producible by casting, rapid solidification or even conventional powder metallurgy techniques. Mechanical alloying has been commercially used to produce dispersion strengthened aluminum, iron and nickel-base alloys. Commercially available dispersion strengthened alloys having significantly improved properties arising from mechanical alloying include alloys such as MA 754, MA 956, MA 6000 and AL-905XL.

During mechanical alloying it is essential to control the welding and fracturing of powders. If powder welds excessively, powder will agglomerate in a mill to form an unworkable heap of powder prior to mechanical alloying. If powder fractures excessively, ultra fine unalloyed particles are formed. Under extreme excess fracture conditions, ultra fine metal powders may become pyrophoric. A process control agent (PCA) is used to balance welding and mechanical fracturing to achieve the desired mechanical alloying. The PCA additives used may be any organic material such as organic acids, alcohols, heptanes, aldehydes and ether. Process control agents may also be a material such as graphite, oxygen and water. Typically, fugitive PCA's partially combine with metal powder during mechanical alloying to form dispersoid strengtheners. Excess PCA (fugitive PCA) must be removed prior to consolidation of canned mechanically alloyed powder. Excess PCA is commonly removed by argon purging followed by a vacuum degas treatment at elevated temperature. After degassing, a consolidation technique such as hot extrusion or hot isostatic pressing is typically used to form degassed mechanically alloyed powder into a metal product.

A conventional PCA such as stearic acid [$CH_3(CH_2)_{16}COOH$], is not useful for mechanical alloying titanium. During mechanical alloying, stearic acid breaks down to introduce oxygen into the milling atmosphere. Oxygen is readily dissolved into the titanium matrix. Dissolved oxygen in titanium rapidly deteriorates mechanical properties. A graphite process control agent also is not always useful for controlling mechanical alloying of titanium-base alloys. Elemental carbon has a very low solubility in titanium. Furthermore, carbon reacts with titanium for form TiC only at a relatively high temperature of above about 1000° C.

Alternatively, temperature may be used to control mechanical alloying. Milling temperature is a factor which controls welding rate during mechanical alloying. Typically, welding rate increases with increased temperature. For example, a liquid nitrogen cooling jacket surrounding a mechanical alloying device has been used to decrease operating temperature for suppressing welding of metal powders. The problem with using a cooling jacket for controlling mechanical alloying is that it is difficult to effectively lower temperature within large vessels that are required for commercially viable operations. In addition, others have added liquid nitrogen directly into a mill for mechanical alloying. The problem with controlling a mechanical alloying operation with liquid nitrogen in the mill is that nitrogen combines with metal powders to adversely affect properties. Nitrogen typically is a harmful ingredient to most alloy systems including titanium-base alloys.

It is an object of this invention to provide an improved process control agent for mechanical alloying titanium-base metal powders.

It is a further object of this invention to provide a method of controlling mechanical alloying without introducing excess oxygen, carbon or nitrogen into a titanium-base matrix.

It is a further object of this invention to provide a process control agent that improves physical properties of titanium-base alloys.

SUMMARY OF THE INVENTION

The invention provides a method of mechanical alloying a titanium-base metal powder. Titanium-base metal powder is provided in a mechanical alloying apparatus. The mechanical alloying apparatus has a controlled atmosphere to prevent excessive oxidation of the titanium-base metal powder. An effective amount of tin process control agent is added to the mechanical alloying apparatus. The mechanical alloying apparatus is operated to weld and fracture the titanium-base metal powder in a manner controlled by the tin process control agent. The controlled welding and fracturing ultimately forms a titanium-base mechanically alloyed powder.

DESCRIPTION OF PREFERRED EMBODIMENT

Figure 1:
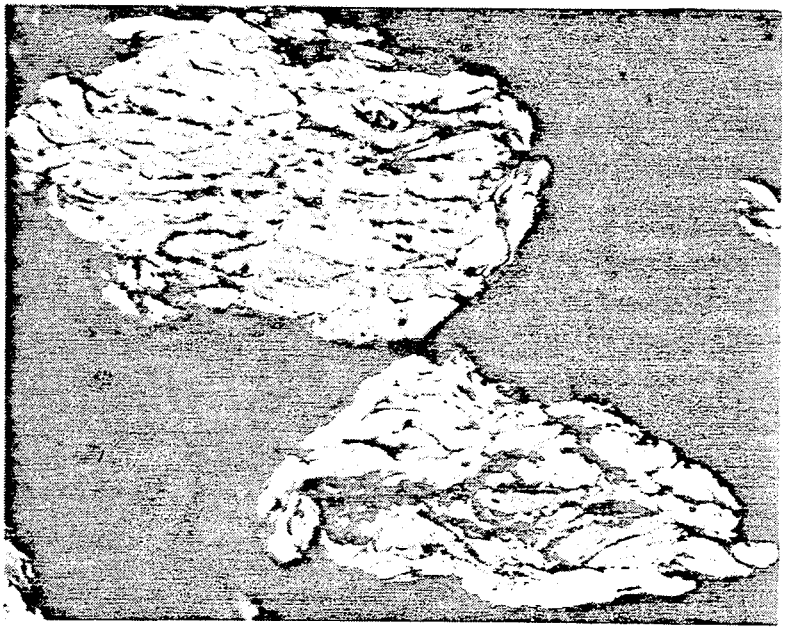
FIG. 1 is a photomicrograph of Ti-36Al-1Sn-2$Y_2O_3$ spex milled in argon after 10 minutes at a magnification of 200X.

It has been discovered that a small amount of tin performs effectively as a process control agent (PCA) to facilitate mechanical alloying of titanium-base metal powders. PCA is defined for purposes of this specification as any ingredient or parameter that may be used to control mechanical alloying. Tin effectively acts as a barrier to prevent excessive welding during initial milling operations by quickly surrounding metal powder.

A tin PCA is believed to provide effective control for use in mechanical alloying of several titanium-base alloys. For purposes of this specification, titanium-base powder includes a combination of starting powders which form titanium-base mechanically alloyed powder. For example, a charge containing 89 wt. % titanium powder, 6 wt. % aluminum powder, 4 wt. % vanadium powder and 1 wt. % tin powder would be considered a titanium-base powder. Approximately 20 wt. % Sn may be dissolved in a titanium matrix. A Sn—Ti phase diagram illustrating the high solubility of tin in titanium is provided in M. Hansen, *Constitution of Binary Alloys*, 2nd Ed., pages 1210–14 (1958). The high solubility limit of Sn in Ti provides a relatively large amount of flexibility in amount of PCA that may be used. Lower limit of tin PCA used is determined by the minimum amount of tin that effectively controls mechanical alloying in a titanium-base powder system. Upper limit of tin used is determined by the maximum amount of tin mechanically alloyed titanium-base alloy system may include while maintaining acceptable properties. Tin, a weak α phase strengthener, is not detrimental to physical properties of titanium-base alloys. In fact, tin is typically beneficial to titanium-base alloys by acting as a solid solution strengthener. Most advantageously, 0.5 to 5 wt. % Sn is used as a process control agent. The maximum amount of solid solution strengthening arising from atomic mismatch occurs with 3–4 wt. % Sn.

Tin is most preferably used as a PCA agent in combination with a titanium-base alloy that includes a powder that has a tendency to over-weld and agglomerate such as aluminum. Titanium-base alloys which include as little as 5 wt. % aluminum have a strong tendency to overweld. A 1 wt. % tin powder addition has been found to effectively control overwelding when milling a titanium-base powder containing 36 wt. % aluminum. Tin PCA may be added in any form which readily reacts with titanium-base metal powders to control mechanical alloying such as tin powder or finely cut tin wire and strip. Most advantageously, tin PCA is added as a tin powder. Advantageously, an inert atmosphere is used for mechanical alloying titanium-base alloys to prevent excess oxidation of titanium. Most advantageously, an argon or helium atmosphere is used to limit oxidation of titanium.

EXAMPLE I

A Spex shaker mill was loaded with Ti-36Al master alloy powder, $Y_2O_3$ powder and Sn process control agent accurately measured to form batches of Ti-36Al-1Sn-2$Y_2O_3$ powder weighing about 6 grams each. The shaker mill contained 0.71 cm diameter alloy 52100 steel balls in a 20:1 weight ratio of balls to powder. The shaker mill was operated in an inert helium or argon atmosphere. The shaker mill was interrupted after various time periods to analyze the effectiveness of a soft metal tin process control agent. Results from various milling times is given below in Table 1.

TABLE 1

| Sample No. | Time (min.) | Loose Powder (g) | Coating on Ball (g) | Coating on Mill (g) | Atmosphere |
|---|---|---|---|---|---|
| 1 | 5 | 5.996 | 0.29 | ~0 | He |
| 2 | 80 | 4.416 | 0.64 | 1.12 | Ar |
| 3 | 5 | 3.757 | 2.45 | ~0 | Ar |
| 4 | 10 | 4.138 | 2.13 | ~0 | Ar |
| 5 | 20 | 5.872 | 0.26 | 0.05 | Ar |
| 6 | 40 | 6.192 | 0.07 | ~0 | Ar |
| 7 | 60 | 5.835 | 0.34 | ~0 | Ar |
| 8 | 80 | 4.05 | 0.82 | 1.4 | Ar |

Figure 2:
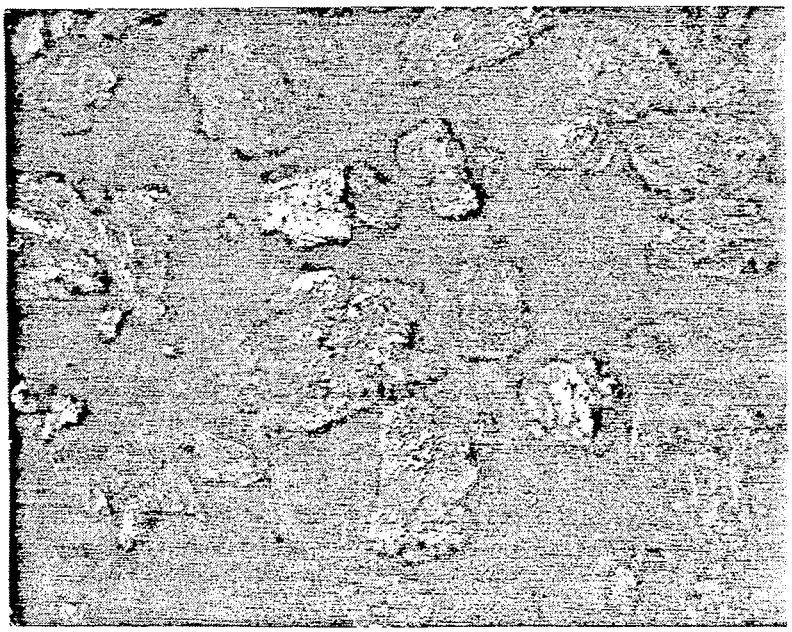
FIG. 2 is a photomicrograph of Ti-36Al-1Sn-2$Y_2O_3$ spex milled in argon after 60 minutes at a magnification of 200X.

The ~ in Tables 1 and 2 is used to designate approximately. In all samples of Table 1 over-welding of titanium was successfully prevented. In continuous or semi-continuous operations wherein equipment is dedicated to a single alloy composition, alloy coatings on balls and mills typically reach a steady state and powder is not lost to ball and mill coating. FIG. 1, taken after 10 minutes of operation illustrates that Sn prevented the uncontrolled agglomeration of aluminum powder in the presence of titanium. FIG. 2, taken after 60 minutes of milling, illustrates an ultra-fine microstructure of powder that has been combined uniformly by repeated welding and fracturing.

EXAMPLE 2

A total of six batches of Ti-36Al-2Sn-2$Y_2O_3$ powders were prepared by combining 6 g Ti-36Al master alloy, 0.12 g Sn powder and 0.12 g $Y_2O_3$. The powder was then placed in helium atmosphere Spex mills. The Spex mill contained 0.71 cm diameter alloy 52100 steel balls in a 20:1 weight ratio of balls to powder. Effectiveness of the Sn process control agent as measured at various times is given below in Table 2.

TABLE 2

| Sample No. | Time (min.) | Loose Powder (g) | Coating on Ball (g) | Coating on Mill (g) | Atmosphere |
|---|---|---|---|---|---|
| 1 | 5 | 5.475 | 0.7 | 0.065 | He |
| 2 | 10 | 5.956 | 0.27 | 0.014 | He |
| 3 | 20 | 6.122 | 0.12 | ~0 | He |
| 4 | 40 | 6.08 | 0.09 | 0.07 | He |
| 5 | 80 | 5.24 | 0.58 | 0.42 | He |

In all samples of Table 2 over-welding of titanium was successfully prevented.

The titanium-base matrix can be strengthened with tin by atomic mismatch as a solid solution strengthener during subsequent processing. The use of a tin PCA in a controlled argon atmosphere successfully prevented the introduction of detrimental oxygen and carbon into the titanium-base alloy. After successfully mechanical alloying titanium-base powder with a tin PCA, the mechanically alloyed powder may be canned, degassed and extruded into a metallic product.

Powders may be mechanically alloyed in any high energy milling device with sufficient energy to bond powders together. Specific milling devices include attritors, ball mills, shaker mills and rod mills. Most advantageously, a ball mill is used for mechanical alloying. Specific milling equipment most suitable for mechanical equipment is disclosed in U.S. Pat. Nos. 4,603,814, 4,653,335, 4,679,736 and 4,887,773.

Most advantageously, titanium-base alloys are canned under a protective inert atmosphere such as argon or helium. The canned powder is then preferably vacuum treated at an elevated temperature to remove as much gas as possible and sealed under vacuum. The canned titanium-base alloy is then consolidated either by hot isostatic pressing or hot extrusion to consolidate the metal powder into a metal product. The consolidated product is then formable into desired parts such as aircraft structural and engine components.

The tin process control agent of the invention provides several advantages. Tin provides an effective method of controlling mechanical alloying without introducing excess oxygen, carbon or nitrogen into an alloy system. Tin combines with titanium-base alloys to eliminate any requirement for removal of fugitive PCA without deteriorating physical properties. Tin has a high solubility in titanium which provides a large amount of flexibility in controlling mechanical alloying by amount of tin PCA. Finally, tin is a low cost additive that does not greatly increase the cost of mechanical alloying. In summary, the use of a tin PCA greatly simplifies mechanical alloying of titanium-base metal powders.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A method of mechanical alloying metallic powders in a controlled manner comprising:

a) providing a titanium-base metal powder in a mechanical alloying apparatus, said mechanical alloying apparatus having a controlled atmosphere to prevent excessive oxidation of said titanium-base metal powder;

b) adding a small but effective amount of metallic tin process control agent to said titanium-base metal powder in said mechanical alloying apparatus to prevent over-welding of said titanium-base powder; and c) operating said mechanical alloying apparatus to weld and fracture said titanium-base metal powder with said metallic tin process control agent to form a titanium-base mechanically alloyed powder.

2. The method of claim 1 wherein said titanium-base metal powder provided includes aluminum powder.

3. The method of claim 1 wherein said titanium-base metal powder provided includes at least 5 wt. % aluminum.

4. The method of claim 1 wherein up to 5 wt. % metallic tin is added to said titanium-base metal powder.

5. The method of claim 1 including the additional step of consolidating said titanium-base mechanically alloyed powder to form a titanium-base product.

6. The method of claim 1 wherein said operating of said mechanical alloying apparatus includes rotating a ball mill.

7. The method of claim 1 including the additional step of adding an inert gas selected from the group consisting of helium and argon to provide said controlled atmosphere.

8. A method of mechanical alloying metallic powders in a controlled manner comprising:

a) providing a titanium-base metal powder in a mechanical alloying apparatus and said mechanical alloying apparatus having a controlled atmosphere to prevent excessive oxidation of said titanium-base metal powder;

b) adding a small but effective amount up to 5 wt. % of metallic tin process control agent to said titanium-base metal powder in said mechanical alloying apparatus to prevent over-welding of said titanium-base powder; and c) operating said mechanical alloying apparatus to weld and fracture said titanium-base metal powder with said metallic tin process control agent to form a titanium-base mechanically alloyed powder.

9. The method of claim 8 including the additional step of consolidating said titanium-base mechanically alloyed powder to form a titanium-base product.

10. The method of claim 8 including the additional step of adding an inert gas selected from the group consisting of helium and argon to provide said controlled atmosphere.

11. The method of claim 8 wherein said titanium-base metal powder provided includes at least 5 wt. % aluminum.

12. The method of claim 8 wherein 0.5 to 5 wt. % metallic tin is added to said metallic titanium-base combination of powder.

13. The method of claim 8 wherein said operating of said mechanical alloying apparatus includes rotating a ball mill.

14. The method of claim 8 wherein said operating of said mechanical alloying apparatus includes rotating a ball mill in an inert atmosphere.

15. The method of claim 8 wherein said tin process control agent is added as a powder.

* * * * *